US009388786B2

(12) United States Patent
Nakano

(10) Patent No.: US 9,388,786 B2
(45) Date of Patent: Jul. 12, 2016

(54) IGNITION SYSTEM

(71) Applicant: NGK SPARK PLUG CO., LTD., Nagoya-shi, Aichi (JP)

(72) Inventor: Daisuke Nakano, Kiyosu (JP)

(73) Assignee: NGK SPARK PLUG CO., LTD., Achi (JP)

( * ) Notice: Subject to any disclaimer, the term of this patent is extended or adjusted under 35 U.S.C. 154(b) by 107 days.

(21) Appl. No.: 14/299,130

(22) Filed: Jun. 9, 2014

(65) Prior Publication Data

US 2014/0368964 A1 Dec. 18, 2014

(30) Foreign Application Priority Data

Jun. 13, 2013 (JP) ..... 2013-124529

(51) Int. Cl.

| | |
|---|---|
| ***F23Q 3/00*** | (2006.01) |
| ***F02P 3/045*** | (2006.01) |
| ***F02P 3/05*** | (2006.01) |
| ***F02P 17/04*** | (2006.01) |
| *F02P 5/145* | (2006.01) |
| *F02P 9/00* | (2006.01) |
| *F02P 17/12* | (2006.01) |

(52) U.S. Cl.

CPC ..... *F02P 3/0453* (2013.01); *F02P 3/051* (2013.01); *F02P 17/04* (2013.01); *F02P 5/145* (2013.01); *F02P 9/002* (2013.01); *F02P 2017/121* (2013.01); *F02P 2017/123* (2013.01)

(58) Field of Classification Search

USPC ..... 361/256

See application file for complete search history.

(56) References Cited

U.S. PATENT DOCUMENTS 5,343,844 A * 9/1994 Fukui ..... G01M 15/042 123/481
5,347,855 A * 9/1994 Miyata ..... F02P 17/12 324/378
6,298,837 B1 10/2001 Ketterer et al.

(Continued)

FOREIGN PATENT DOCUMENTS

DE 102009057925 A1 6/2011
DE 102012218420 A1 11/2014

(Continued)

OTHER PUBLICATIONS

Communication dated May 7, 2015 from the Japanese Patent Office in counterpart application No. 2013-124529.
Communication dated Nov. 24, 2014 from the European Patent Office in counterpart application No. 14171921.1.

*Primary Examiner* — Ronald W Leja
(74) *Attorney, Agent, or Firm* — Sughrue Mion, PLLC

(57) ABSTRACT

An ignition system including: a first control unit configured to generate a high voltage that is to be supplied to a spark plug at a secondary winding of an ignition coil by applying and then cutting off a primary current to a primary winding of the ignition coil; a second control unit configured to cut off electric power supplied from the secondary winding to the spark plug by energizing the primary winding after the first control unit cuts off the primary current; a re-energizing current measuring unit configured to measure a re-energizing current energizing the primary winding by the second control unit; and an energizing period determining unit configured to determine an energizing period during which the primary current is applied to the primary winding by the first control unit, corresponding to the re-energizing current measured by the re-energizing current measuring unit.

4 Claims, 9 Drawing Sheets

(56) References Cited

U.S. PATENT DOCUMENTS

| | | | | |
|---|---|---|---|---|
| 2002/0170547 | A1* | 11/2002 | Lepley | F02P 3/08 123/604 |
| 2007/0252744 | A1* | 11/2007 | Takeuchi | H03M 1/1076 341/155 |
| 2012/0312285 | A1 | 12/2012 | Bolz et al. | |
| 2013/0192570 | A1 | 8/2013 | Kajita et al. | |
| 2014/0368964 | A1* | 12/2014 | Nakano | F02P 3/0453 361/256 |

FOREIGN PATENT DOCUMENTS

| | | | |
|---|---|---|---|
| EP | 1201920 | A2 | 5/2002 |
| JP | 2001-193622 | A | 7/2001 |
| JP | 2001-304085 | A | 10/2001 |
| JP | 2004-92506 | A | 3/2004 |
| JP | 2009-30554 | A | 2/2009 |

* cited by examiner

IGNITION SYSTEM

BACKGROUND OF THE INVENTION

1. Field of the Invention

This invention relates to an ignition system for an internal combustion engine.

2. Description of the Related Art

A known ignition system of an internal combustion engine, for example, cuts off a primary current after applying the primary current to a primary winding. This generates a high voltage that is supplied to a spark plug at a secondary winding. The ignition system disclosed in JP-A-2001-193622 energizes the primary winding again at a timing corresponding to an operating state (for example, engine speed and load) of the internal combustion engine after cutting off the primary current, thus cutting off electric power supplied to the spark plug from the secondary winding. This ignition system prevents electric power from being excessively supplied to the spark plug, and thus enhances the durability of the spark plug.

3. Problems to be Solved by the Invention

The ignition system disclosed in JP-A-2001-193622 does not take into consideration that electric power consumed by the time spark discharge occurs depends on the physical state of the spark plug. Hence, if electric power consumed by the time spark discharge occurs is increased, electric power supplied to the spark plug during the spark discharge is excessively reduced. As a result, there may be a shortage of electric power required for ignition by spark discharge. For example, if a spark gap in the spark plug increases due to electrode wear, a higher voltage will be required to generate spark discharge, resulting in greater loss of electric power caused by a step-up in voltage between the electrodes. In addition, if carbon deposits (fouling or smoking dirt) are present due to carbon adhesion in the spark plug, the insulation resistance between electrodes will decrease, resulting in yet greater loss of electric power due to current leakage. As described above, the increased spark gap and the presence of carbon deposits will increase electric power consumed by the time spark discharge occurs.

SUMMARY OF THE INVENTION

The invention has been made to solve the above problems of the related art by providing (1) an ignition system which includes: a first control unit configured to generate a high voltage that is to be supplied to a spark plug at a secondary winding of an ignition coil by applying and then cutting off a primary current to a primary winding of the ignition coil; a second control unit configured to cut off electric power supplied from the secondary winding to the spark plug by energizing the primary winding after the first control unit cuts off the primary current; a re-energizing current measuring unit configured to measure a re-energizing current energizing the primary winding by the second control unit; and an energizing period determining unit configured to determine an energizing period during which the primary current is applied to the primary winding by the first control unit, corresponding to the re-energizing current measured by the re-energizing current measuring unit.

According to this aspect of the invention, a period during which a primary current is applied, which allows for sufficient supply of electric power to a spark plug during spark discharge, is determined based on a re-energizing current correlated to energy that remains in the primary and secondary windings after spark discharge has ended. Accordingly, a shortage of electric power required for ignition by spark discharge can be avoided. As a result, the durability of a spark plug can be enhanced while avoiding a shortage of electric power required for ignition by spark discharge. Notably, electric power consumed by the time spark discharge occurs may increase as the state of a spark plug changes. In this case, electric power remaining in the primary and secondary windings after spark discharge has ended will decrease, resulting in a smaller re-energizing current. In some cases, conversely, electric power consumed before the occurrence of spark discharge can decrease as the state of a spark plug changes. In these cases, electric power remaining in the primary and secondary windings after spark discharge has ended will increase, resulting in a greater re-energizing current.

In a preferred embodiment (2), the ignition system (1) further includes a primary current measuring unit configured to measure the primary current, wherein the energizing period determining unit is configured to determine the energizing period corresponding to the re-energizing current measured by the re-energizing current measuring unit and the primary current measured by the primary current measuring unit.

According to this aspect of the invention, a variation in electric power supplied to the primary winding, which is caused by a variation in the primary current, can be reduced.

In another preferred embodiment (3) of the ignition system (1) or (2) above, the energizing period determining unit includes: an extension unit configured to extend the energizing period so as to be greater than a reference value when the re-energizing current measured by the re-energizing current measuring unit is smaller than a first threshold; and a shortening unit configured to shorten the energizing period so as to be smaller than the reference value when the re-energizing current measured by the re-energizing current measuring unit is larger than a second threshold.

This aspect allows an energizing period for a primary current to be adjusted corresponding to deterioration and recovery of the spark plug.

In yet another preferred embodiment (4), the ignition system of any of (1) to (3) above further comprises an abnormality determining unit configured to determine that the spark plug is abnormal when the re-energizing current measured by the re-energizing current measuring unit is smaller than a third threshold.

This aspect allows the primary winding and a circuit component (e.g., a switch) that supplies a primary current to the primary winding to avoid malfunction due to an excessive current, based on a determination that the spark plug is abnormal.

In yet another preferred embodiment (5) of the ignition system of any of (1) to (4) above, the energizing period determining unit may determine the energizing period corresponding to the re-energizing current measured by the re-energizing current measuring unit for each of a plurality of spark plugs associated with the ignition system.

This aspect of the invention makes it possible to avoid a shortage of electric power required for ignition by spark discharge for each of the spark plugs.

The present invention can be embodied in various aspects other than an ignition system. The present invention can be embodied, for example, as an ignition method, a computer program for achieving the ignition method, and a permanent recording medium on which the computer program is recorded.

DETAILED DESCRIPTION OF THE PREFERRED EMBODIMENTS

Figure 1:
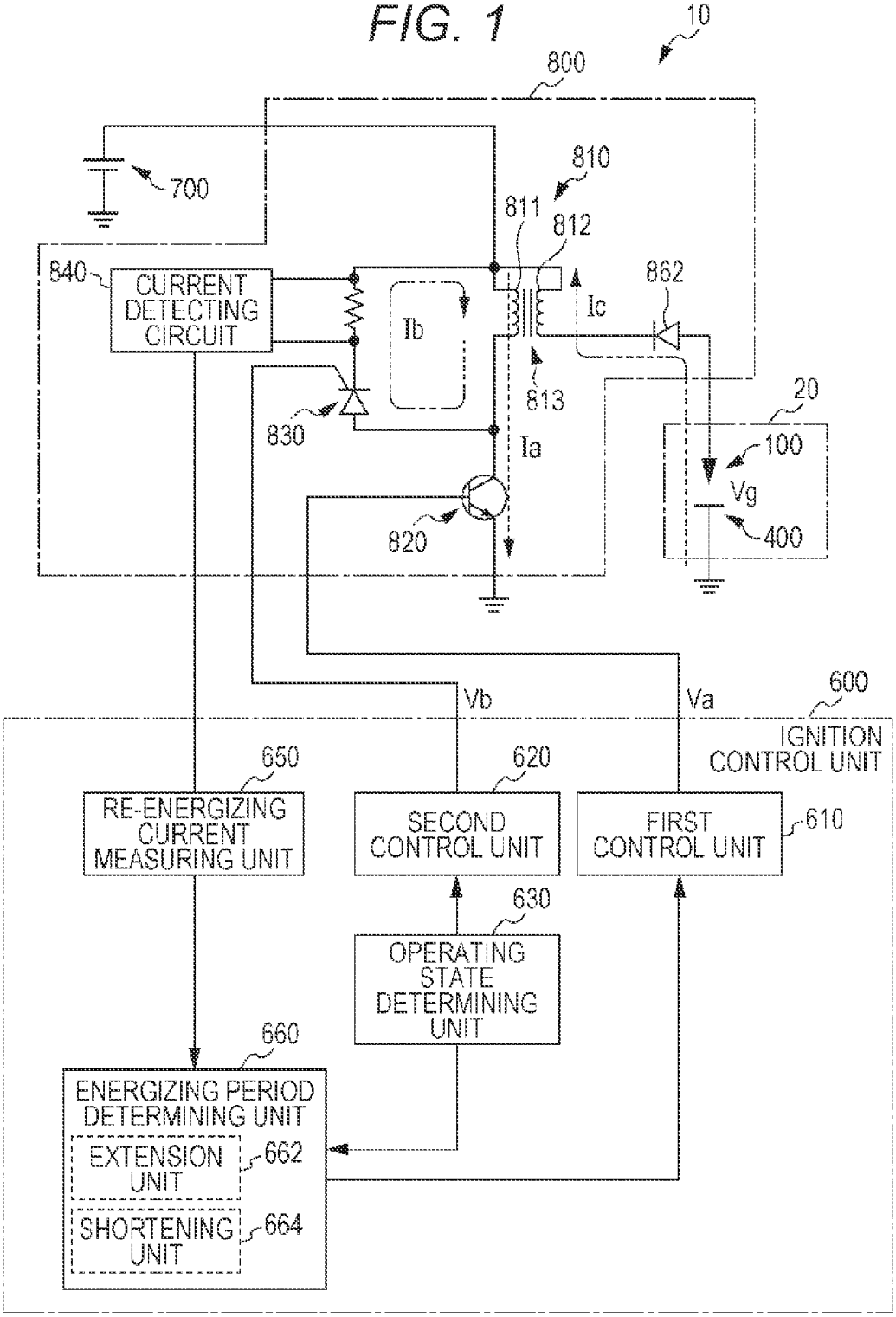
FIG. 1 is an explanatory diagram of an ignition system.

In the following detailed description and by reference to the drawings, for purpose of explanation, numerous specific details are set forth in order to provide a thorough understanding of the disclosed embodiments. However, the present invention should not be construed as being limited thereto. It will be apparent that one or more embodiments may be practiced without these specific details. In other instances, well-known structures and devices are schematically shown in order to simplify the drawing.

A. First Embodiment

A-1. Ignition System Components

FIG. 1 is an explanatory diagram of an ignition system 10. The ignition system 10 generates a spark discharge in a gap between a center electrode 100 and a ground electrode 400 of a spark plug 20. This causes the ignition system 10 to ignite an air-fuel mixture inside of a combustion chamber of an internal combustion engine (not illustrated). The ignition system 10 includes the spark plug 20, an ignition control unit 600, a DC power source 700 and an ignition circuit 800. In this embodiment, the ignition system 10 is mounted on a vehicle together with the internal combustion engine. The DC power source 700 of the ignition system 10 is a lead-acid battery mounted on a vehicle.

In this embodiment, the ignition system 10 includes one spark plug 20 and one ignition circuit 800. In another embodiment, the ignition system 10 may include a plurality of spark plugs 20 in compliance with the specifications of an internal combustion engine and a plurality of ignition circuits 800 corresponding to respective spark plugs 20. In this case, the ignition control unit 600 individually controls the ignition circuits 800 corresponding to the respective spark plugs 20.

The ignition circuit 800 of the ignition system 10 includes a plurality of circuit components. The ignition circuits 800 draw electric power from the DC power source 700 to apply a high voltage to the spark plug 20, based on a control signal from the ignition control unit 600. The ignition circuit 800 includes an ignition coil 810, a switch 820, a switch 830, a current detecting circuit 840 and a diode 862. The ignition coil 810 of the ignition circuit 800 includes a primary winding 811, a secondary winding 812 and a core 813.

One end of the primary winding 811 is connected to the DC power source 700. The other end of the primary winding 811 is connected to the switch 820. One end of the secondary winding 812 is connected to the DC power source 700 and the primary winding 811. The other end of the secondary winding 812 is connected to the center electrode 100 of the spark plug 20. The primary winding 811 and the secondary winding 812 are wound at positions facing each other at the core 813.

The diode 862 is disposed between the spark plug 20 and the secondary winding 812. The diode 862 adjusts a current Ic which flows from the spark plug 20 to the secondary winding 812. The current Ic is a discharge current that flows during the occurrence of a spark discharge between the center electrode 100 and the ground electrode 400 in the spark plug 20.

The switch 820 switches on and off electric power supply from the DC power source 700 to the primary winding 811, based on a control signal Va from the ignition control unit 600. In this embodiment, if the control signal Va is at a low level (Lo level), the switch 820 is in an off state. In this case, no current flows to the primary winding 811. In this embodiment, if the control signal Va is at a high level (Hi level), the switch 820 is in an on state. In this case, a current Ia flows from the primary winding 811 to the switch 820. The current Ia is a primary current that accumulates electric energy in the primary winding 811.

The switch 830 switches on and off an electric connection between both ends of the primary winding 811, based on a control signal Vb from the ignition control unit 600. In this embodiment, the switch 830 is a thyristor. In this embodiment, if the control signal Vb is at a low level (Lo level), the switch 830 is in an off state, and no current flows between both ends of the primary winding 811. If the control signal Vb is at a high level (Hi level), on the other hand, the switch 830 is in an on state in this embodiment. In this case, a current Ib flows from the switch 820 side end of the primary winding 811 to the DC power source 700 side end of the primary winding 811. The current Ib is a re-energizing current. The current detecting circuit 840 for detecting the current Ib is disposed between the primary winding 811 and the switch 830.

The ignition control unit 600 of the ignition system 10 applies a high voltage between the center electrode 100 and the ground electrode 400 of the spark plug 20 by controlling the ignition circuit 800. Thus, spark discharge occurs between the center electrode 100 and the ground electrode 400. The ignition control unit 600 includes a first control unit 610, a second control unit 620, an operating state determining unit 630, a re-energizing current measuring unit 650, and an energizing period determining unit 660.

The first control unit 610 of the ignition control unit 600 generates a high voltage to be supplied to the spark plug 20 at the secondary winding 812 by cutting off the current Ia after applying the current Ia to the primary winding 811. In this embodiment, the first control unit 610 controls conduction and cutoff of the current Ia by outputting a control signal Va to the switch 820.

The second control unit 620 of the ignition control unit 600 cuts off the electric power supplied from the secondary winding 812 to the spark plug 20 by energizing the primary winding 811 after the first control unit 610 cuts off the current Ia. In this embodiment, the second control unit 620 controls cutoff of electric power supplied from the secondary winding 812 to the spark plug 20, by outputting a control signal Vb to the switch 830.

The operating state determining unit 630 of the ignition control unit 600 determines an operating state of the internal combustion engine on which the spark plug 20 is installed. In this embodiment, the operating state determining unit 630 determines the operating state of the internal combustion engine, based on throttle opening, an intake pressure, an engine speed, an intake temperature, or the like.

The re-energizing current measuring unit 650 of the ignition control unit 600 measures the current Ib energizing the primary winding 811 by the second control unit 620. In this embodiment, the re-energizing current measuring unit 650 measures the current Ib by obtaining measurement data indicating the current Ib from the current detecting circuit 840.

The energizing period determining unit 660 of the ignition control unit 600 determines an energizing period Teg, depending on the current Ib measured by the re-energizing current measuring unit 650. The energizing period Teg is a length of time during which the current Ia is applied to the primary winding 811 by the first control unit 610.

In this embodiment, the energizing period determining unit 660 includes an extension unit 662 and a shortening unit 664. The extension unit 662 of the energizing period determining unit 660 extends the energizing period Teg so as to be greater than a reference energizing period Tbs if the current Ib measured by the re-energizing current measuring unit 650 is smaller than a first threshold Th1. The energizing period determining unit 660 shortens the energizing period Teg so as to be smaller than the reference energizing period Tbs if the current Ib measured by the re-energizing current measuring unit 650 is larger than a second threshold Th2. The reference energizing period Tbs is set as a reference value for the energizing period Teg, depending on an operating state determined by the operating state determining unit 630.

In this embodiment, respective members included in the ignition control unit 600 are achieved in software by a CPU operation based on a computer program. In other embodiments, at least one member included in the ignition control unit 600 may be achieved in hardware based on a circuit included in the ignition control unit 600.

A-2. How the Ignition System Works

Figure 2:
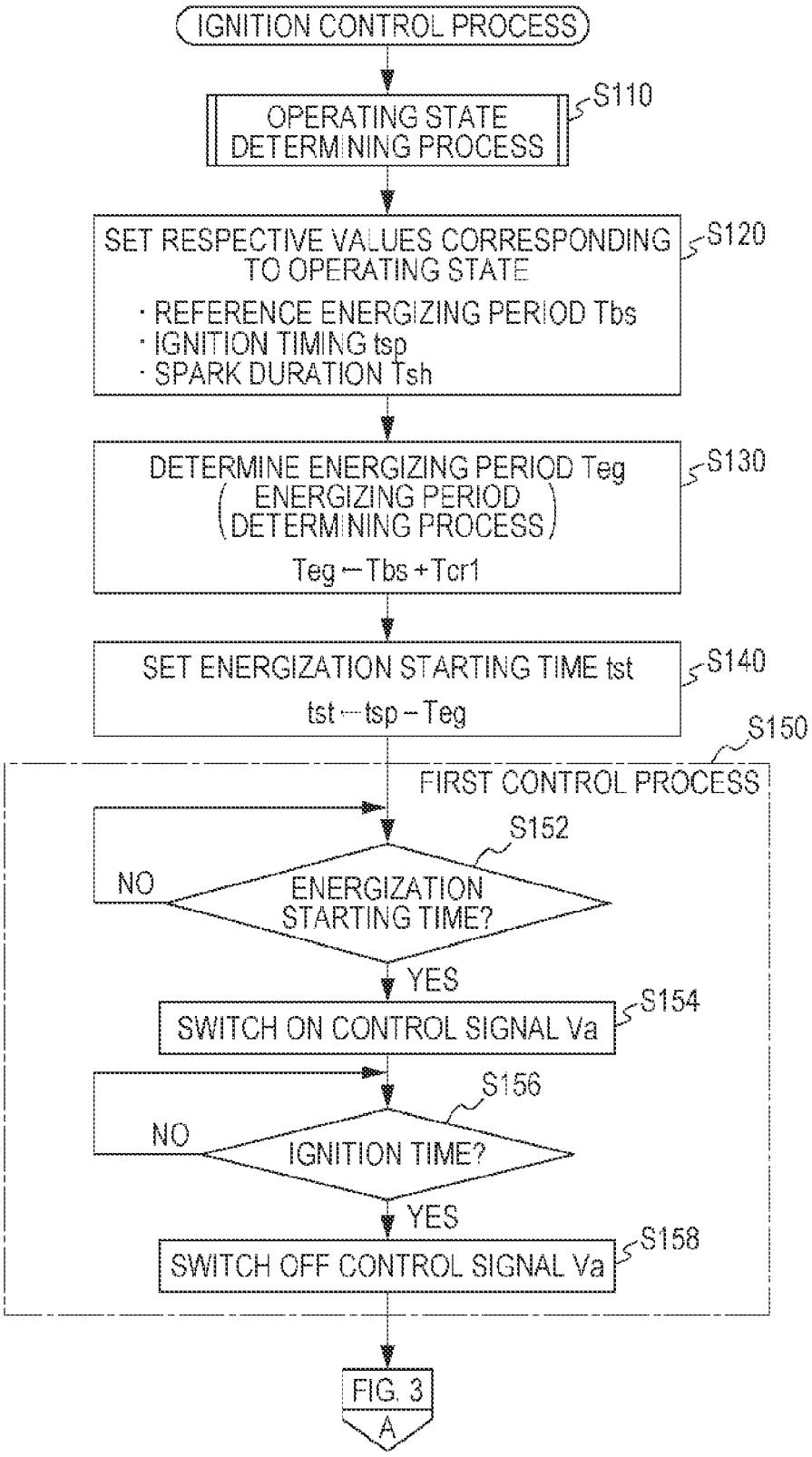
FIG. 2 is an explanatory diagram of an ignition control process.
Figure 3:
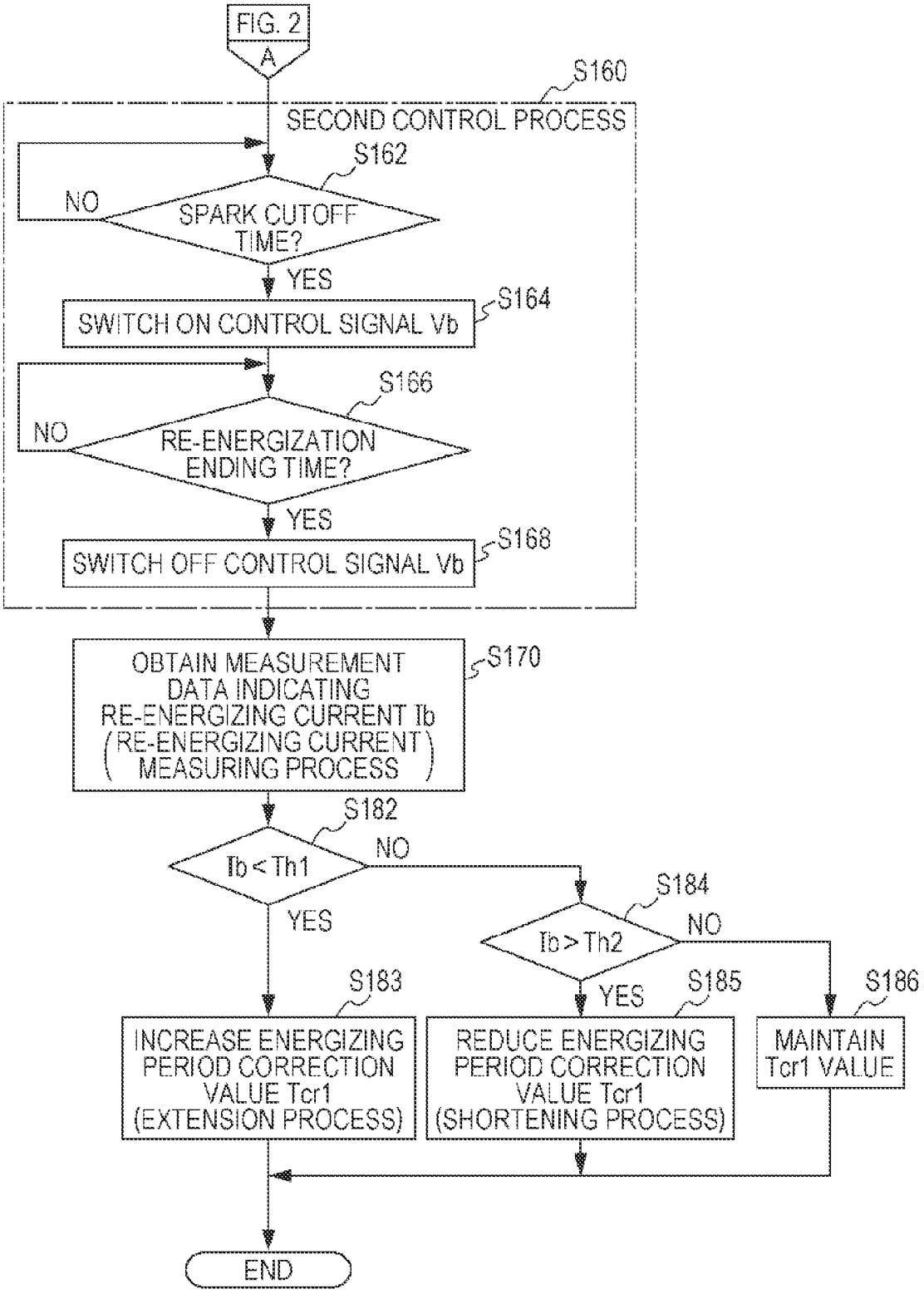
FIG. 3 is an explanatory diagram of the ignition control process.

FIGS. 2 and 3 are explanatory diagrams of an ignition control process. The ignition control unit 600 executes the ignition control process at a timing corresponding to an operating state of the internal combustion engine.

The ignition control unit 600 operates as the operating state determining unit 630 when the ignition control process is started. Accordingly, the ignition control unit 600 executes an operating state determining process (Step S110). In the operating state determining process (Step S110), the ignition control unit 600 determines an operating state of the internal combustion engine on which the spark plug 20 is installed.

After executing the operating state determining process (Step S110), the ignition control unit 600 sets a reference energizing period Tbs, an ignition timing tsp, and a spark duration Tsh (Step S120) depending on the operating state determined by the operating state determining process (Step S110). The ignition timing tsp is a timing at which a high voltage is applied to the spark plug 20. The spark duration Tsh is a length of time during which a spark discharge is maintained in the spark plug 20. In this embodiment, corresponding to a plurality of operating states, the ignition control unit 600 refers to data whose respective values are mapped in advance. Thus, the ignition control unit 600 then sets the respective values corresponding to the operating state determined by the operating state determining process (Step S110).

After setting the respective values corresponding to the operating state (Step S120), the ignition control unit 600 determines an energizing period Teg by operating as the energizing period determining unit 660 (Step S130). In this embodiment, the ignition control unit 600 determines the energizing period Teg by adding an energizing period correction value Tcr1 that was set when executing the previous ignition control process to the reference energizing period Tbs that was set in the current ignition control process. In this embodiment, the previous ignition control process does not exist if the ignition control unit 600 executes the initial ignition control process. Accordingly, the ignition control unit 600 takes the energizing period correction value Tcr1 as "0" to determine the energizing period Teg.

After determining the energizing period Teg (Step S130), the ignition control unit 600 sets an energization starting time tst, which is a timing for energizing the primary winding 811 (Step S140). In this embodiment, the ignition control unit 600 sets a timing traced back from the ignition timing tsp by the energizing period Teg as the energization starting time tst.

After setting the energization starting time tst (Step S140), the ignition control unit 600 executes a first control process (Step S150) by operating as the first control unit 610. In the first control process (Step S150), the ignition control unit 600 waits until the energization starting time tst ("NO" at Step S152). When the energization starting time tst has been reached ("YES" at Step S152), the ignition control unit 600 switches the level of the control signal Va from low to high. That is, the ignition control unit 600 switches the control signal Va from an off state to an on state (Step S154). Then, the current Ia flows through the primary winding 811, which in turns creates a magnetic field at the core 813.

After switching the control signal Va to the on state (Step S154), the ignition control unit 600 waits until the ignition timing tsp ("NO" at Step S156). When the ignition timing tsp is reached ("YES" at Step S156), the ignition control unit 600 switches the level of the control signal Va from high to low. That is, the ignition control unit 600 switches the control signal Va from the on state to the off state (Step S158), which changes the magnetic field created at the core 813. As a result, a primary voltage by the self-induction effect is generated at the primary winding 811. Furthermore, a high voltage of negative polarity is generated at the secondary winding 812. This high voltage is applied to the spark plug 20. Thus, spark discharge occurs at the spark plug 20. After switching the control signal Va to the off state (Step S158), the ignition control unit 600 terminates the first control process (Step S150).

After terminating the first control process (Step S150), the ignition control unit 600 executes a second control process (Step S160) by operating as the second control unit 620. In the second control process (Step S160), the ignition control unit 600 waits until a spark cutoff time tb1 ("NO" at Step S162). The spark cutoff time tb1 is a timing that the spark duration Tsh has passed since the ignition timing tsp. If the spark cutoff time tb1 has been reached ("YES" at Step S162), the ignition control unit 600 switches the level of the control signal Vb from low to high. That is, the ignition control unit 600 switches the control signal Vb from the off state to the on state (Step S164). As a result, the current Ib flows through the primary winding 811, and the electric power supplied from the secondary winding 812 to the spark plug 20 is cut off. This cutoff of the electric power eliminates the spark discharge at the spark plug 20.

After switching the control signal Vb to the on state (Step S164), the ignition control unit 600 waits until a re-energization ending time tb2 ("NO" at Step S166). The re-energization ending time tb2 is a timing for terminating energization of the primary winding 811 with the current Ib. In this embodiment, the re-energization ending time tb2 is set to a fixed value regardless of its operation conditions. If the re-energization ending time tb2 has been reached ("YES" at Step S166), the ignition control unit 600 switches the level of the control signal Vb from high to low. That is, the ignition control unit 600 switches the control signal Vb from an on state to an off state (Step S168). After switching the control signal Vb to the off state (Step S168), the ignition control unit 600 terminates the second control process (Step S160).

After terminating the second control process (Step S160), the ignition control unit 600 executes a re-energizing current measuring process (Step S170) by operating as the re-energizing current measuring unit 650. In the re-energizing current measuring process (Step S170), the ignition control unit 600 measures the current Ib energizing the primary winding 811 in the second control process (Step S160). In this embodiment, the ignition control unit 600 measures a maximum value of the current Ib by obtaining measurement data indicating the current Ib from the current detecting circuit 840. In this embodiment, the current detecting circuit 840 includes a peak hold circuit. This peak hold circuit holds the maximum value of the current Ib as an electric charge accumulated in a capacitor. The ignition control unit 600 can measure the maximum value of the current Ib even after terminating the second control process (Step S160) by measuring the voltage of the capacitor in the peak hold circuit of the current detecting circuit 840.

After measuring the current Ib (Step S170), the ignition control unit 600 operates as the extension unit 662 if the current Ib is smaller than the first threshold Th1 ("YES" at Step S182). Accordingly, the ignition control unit 600 increases the energizing period correction value Tcr1 so as to be greater than the present value (Step S183). The ignition control unit 600 uses this energizing period correction value Tcr1 in an energizing period determining process (Step S130) in the next ignition control process. After setting the energizing period correction value Tcr1, the ignition control unit 600 terminates the ignition control process.

After measuring the current Ib (Step S170), the ignition control unit 600 operates as the shortening unit 664 if the current Ib is larger than the second threshold Th2 ("YES" at Step S184). As a result, the ignition control unit 600 reduces the energizing period correction value Tcr1 from the present value (Step S185). The ignition control unit 600 uses this energizing period correction value Tcr1 in an energizing period determining process (Step S130) in the next ignition control process. After setting the energizing period correction value Tcr1, the ignition control unit 600 terminates the ignition control process.

If the current Ib is equal to or more than the first threshold Th1 and equal to or less than the second threshold Th2, ("NO" at Step S182 and "NO" at Step S184), the ignition control unit 600 maintains the energizing period correction value Tcr1 as the present value (Step S186). The ignition control unit 600 uses this energizing period correction value Tcr1 in the energizing period determining process (Step S130) in the next ignition control process. After setting the energizing period correction value Tcr1, the ignition control unit 600 terminates the ignition control process.

Figure 4:
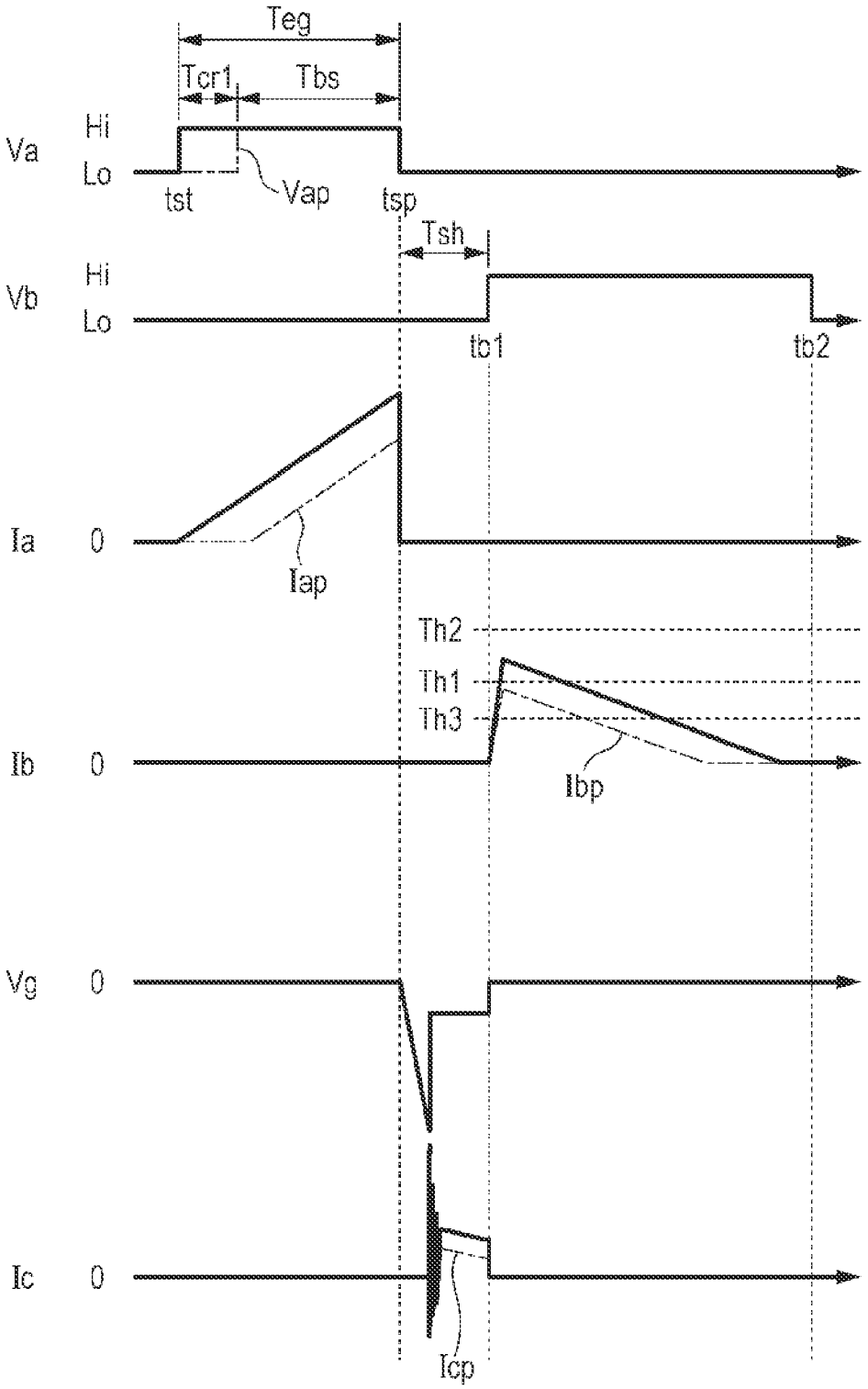
FIG. 4 is a timing chart of current and voltage wave forms generated through an ignition control process in an ignition system.

FIG. 4 is a timing chart illustrating current and voltage wave forms in an ignition control process in the ignition system 10. FIG. 4 illustrates a wave form for the control signal Va, the control signal Vb, the current Ia, the current Ib, the voltage Vg, and the current Ic, in order from the top. In the respective timing charts of FIG. 4, the vertical axis indicates the magnitude of respective signals (a control signal, a current, and a voltage), and the horizontal axis indicates a passage of time, where time passes from left to right on the page of FIG. 4.

The level of the control signal Va switches from low to high at the time point of the energization starting time tst. The control signal Va holds the high level until the ignition timing tsp, which is a time point when the energizing period Teg has passed since the energization starting time tst. The energization starting time tst of the control signal Va in the current ignition control process is time shifted by the energizing period correction value Tcr1, compared with an energization starting time of a control signal Vap in the previous ignition control process. In the example illustrated in FIG. 4, the energization starting time tst of the control signal Va is a timing that is earlier by the energizing period correction value Tcr1, compared with the energization starting time of the control signal Vap.

The current Ia continues to increase while the control signal Va remains at the high level, which is from the energization starting time tst to the ignition timing tsp. The current Ia at the ignition timing tsp in the present ignition control process is an increased or decreased amount corresponding to the energizing period correction value Tcr1, compared with a current Iap at the ignition timing tsp in the previous ignition control process. In the example of FIG. 4, the current Ia of the ignition timing tsp increases by the amount corresponding to the energizing period correction value Tcr1, compared with the current Iap at the ignition timing tsp.

The level of the control signal Va switches from high to low at the time point of the ignition timing tsp. As a result, the current Ia is cut off and the voltage Vg starts to increase. When a dielectric breakdown occurs between the center electrode 100 and the ground electrode 400 due to an increase in the voltage Vg, spark discharge occurs at the spark plug 20. When spark discharge shifts from capacitance discharge to inductive discharge, the voltage Vg and the current Ic stabilize. The current Ic in the previous ignition control process is an increased or decreased amount corresponding to the energizing period correction value Tcr1, compared with a current Icp in the previous ignition control process. In the example of FIG. 4, the current Ic increases by the amount corresponding to the energizing period correction value Tcr1, compared with the current Icp.

The level of the control signal Vb switches from low to high at the spark cutoff time tb1, which is a time point when the spark duration Tsh has passed since the ignition timing tsp. Then, the control signal Vb remains at the high level until the re-energization ending time tb2.

The current Ib increases at the spark cutoff time tb1 to reach a maximum value, and then starts to decrease, then ceases to flow before the re-energization ending time tb2. The current Ib in the current ignition control process is an increased or decreased amount corresponding to the energizing period correction value Tcr1, compared with a current Ibp in the previous ignition control process. In the example of FIG. 4, the current Ib increases by an amount corresponding to the energizing period correction value Tcr1, compared with the current Ibp.

Figure 5:
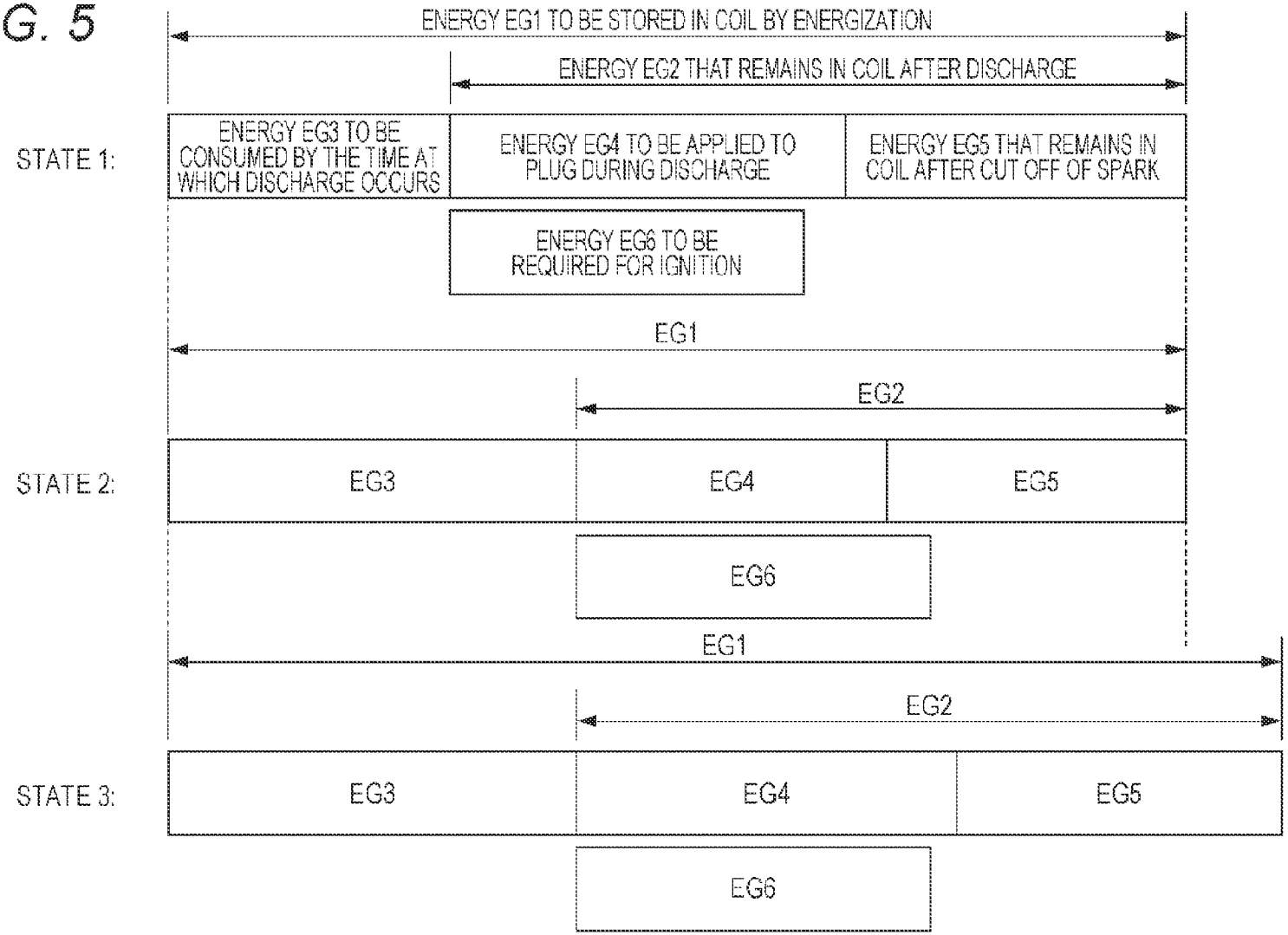
FIG. 5 is an explanatory diagram of energy states stored in an ignition coil.

FIG. 5 is an explanatory diagram of energy states stored in the ignition coil 810. State 1 in FIG. 5 is a state where there is no increase in spark gap or the presence of carbon deposits in the spark plug 20. State 2 in FIG. 5 is a state where there is an increase in a spark gap or the presence of carbon deposits in the spark plug 20. State 2 is also a state where the energizing period Teg has not been corrected by the energizing period correction value Tcr1. State 3 in FIG. 5 is a state where there is an increase in spark gap or the presence of carbon deposits in the spark plug 20. This State 3 is also a state where the energizing period Teg has been extended by the energizing period correction value Tcr1. Lateral lengths of the respective energies illustrated in FIG. 5 indicate an amount of the respective energies.

Energy EG1 is stored in the ignition coil 810 by energization. The energy EG1 can be divided into energy EG3 and energy EG2. The energy EG3 is the energy which is consumed by the time at which discharge occurs. The energy EG2 is the energy which remains in the ignition coil 810 after discharge occurs. Among the energy EG3 and the energy EG2, the energy EG2 is further divided into energy EG4 and energy EG5. The energy EG4 is the energy which is applied to the spark plug 20 during the occurrence of the discharge. The energy EG5 is the energy which remains in the ignition coil 810 after cutting off the spark. In State 1, the energy EG4, which is applied to the spark plug 20, is sufficiently larger than an energy EG6 required for ignition.

In State 2, the energy EG3, which is consumed by discharge, has increased due to an increase in a spark gap or the presence of carbon deposits compared with State 1. Furthermore, the energy EG2, which remains in the ignition coil 810 after the occurrence of the discharge, decreases by the increased amount of the energy EG3. As a result, in State 2, the energy EG4, which is applied to the spark plug 20, cannot satisfy the energy EG6 required for ignition.

In State 3, the energy EG1 stored in the ignition coil 810 by energization increases depending on how long the energizing period Teg has been extended compared with State 1. Hence, the energy EG2 that remains in the ignition coil 810 after the occurrence of the discharge is reserved to a same extent as that for State 1. As a result, the energy EG4, which is applied to the spark plug 20, is sufficiently greater than the energy EG6 required for ignition.

According to the above-described first embodiment, the energizing period Teg for the current Ia, which allows sufficient supply of electric power to the spark plug 20 during the occurrence of spark discharge, is determined based on the current Ib, which is correlated to the energy that remains in the ignition coil 810 after the spark discharge ends. Accordingly, a shortage of electric power required for ignition by spark discharge can be avoided. As a result, durability of the spark plug 20 can be enhanced while avoiding a shortage of electric power required for ignition by spark discharge. The energizing period determining unit 660 includes the extension unit 662 and the shortening unit 664. Hence, the energizing period determining unit 660 can adjust the energizing period Teg depending on the extent to which the spark plug 20 has been deteriorated and recovered. In addition, if more electric power is supplied to the spark plug 20 than the energy EG6 required for ignition, an electrode in the spark plug 20 wears quickly. Hence, the energy EG4, which is supplied to the spark plug 20 during the occurrence of discharge is restricted to the minimum necessary. This allows reducing the electrode wear in the spark plug 20.

B. Second Embodiment

Figure 6:
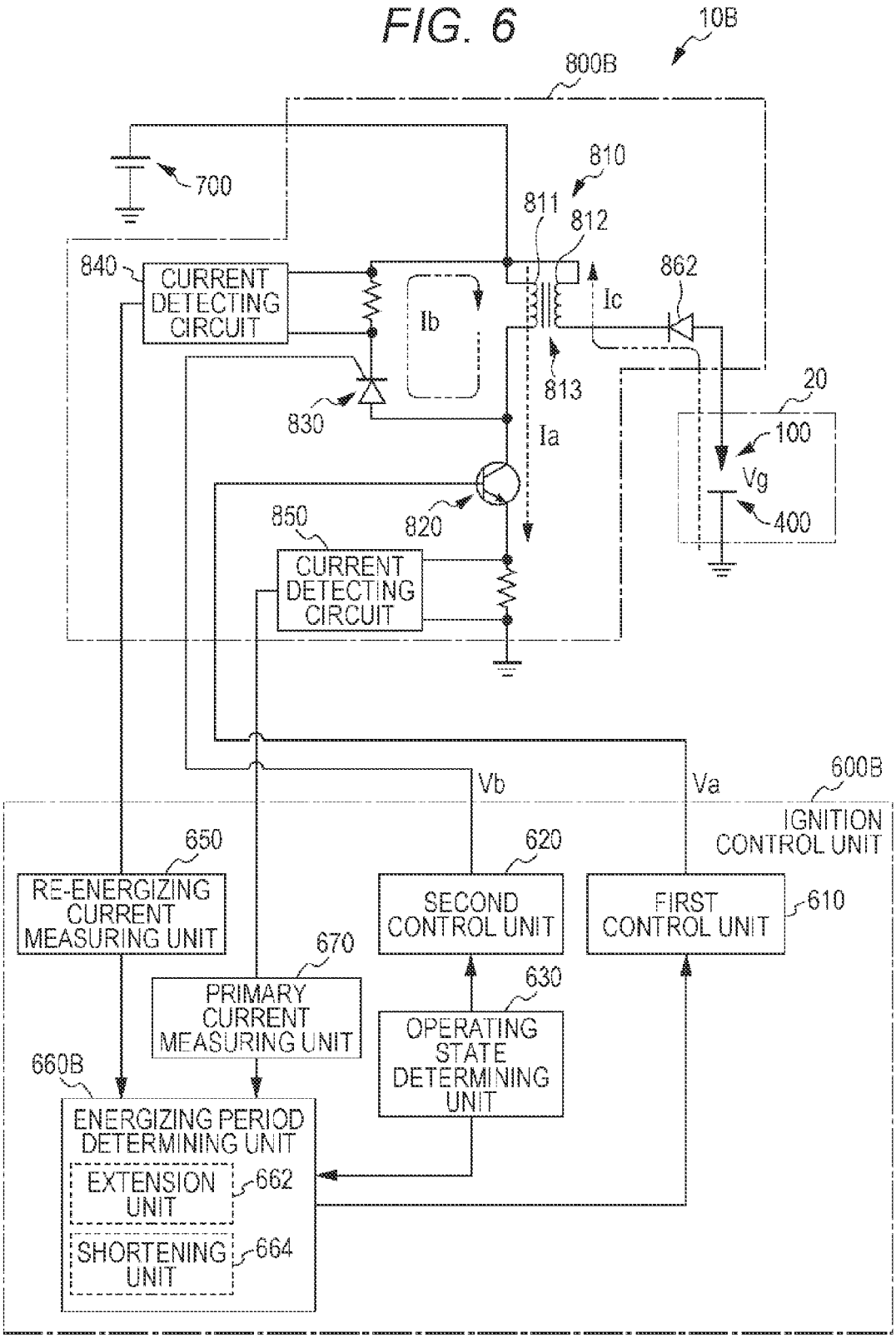
FIG. 6 is an explanatory diagram of an ignition system in a second embodiment.

FIG. 6 is an explanatory diagram of an ignition system 10B in the second embodiment. The ignition system 10B in the second embodiment is similar to the ignition system 10 in the first embodiment, except for including an ignition control unit 600B instead of the ignition control unit 600 and except including an ignition circuit 800B instead of the ignition circuit 800.

The ignition circuit 800B in the second embodiment is similar to the ignition circuit 800 in the first embodiment, except that it includes a current detecting circuit 850. The current detecting circuit 850 detects the current Ia.

The ignition control unit 600B in the second embodiment is similar to the ignition control unit 600 in the first embodiment, except for including a primary current measuring unit 670 for measuring the current Ia and except for including an energizing period determining unit 660B instead of the energizing period determining unit 660. In this embodiment, the primary current measuring unit 670 of the ignition control unit 600B measures the current Ia by obtaining measurement data indicating the current Ia from the current detecting circuit 850. The energizing period determining unit 660B is similar to the energizing period determining unit 660 in the first embodiment, except that the energizing period determining unit 660 determines an energizing period Teg corresponding to the current Ia and current Ib.

Figure 7:
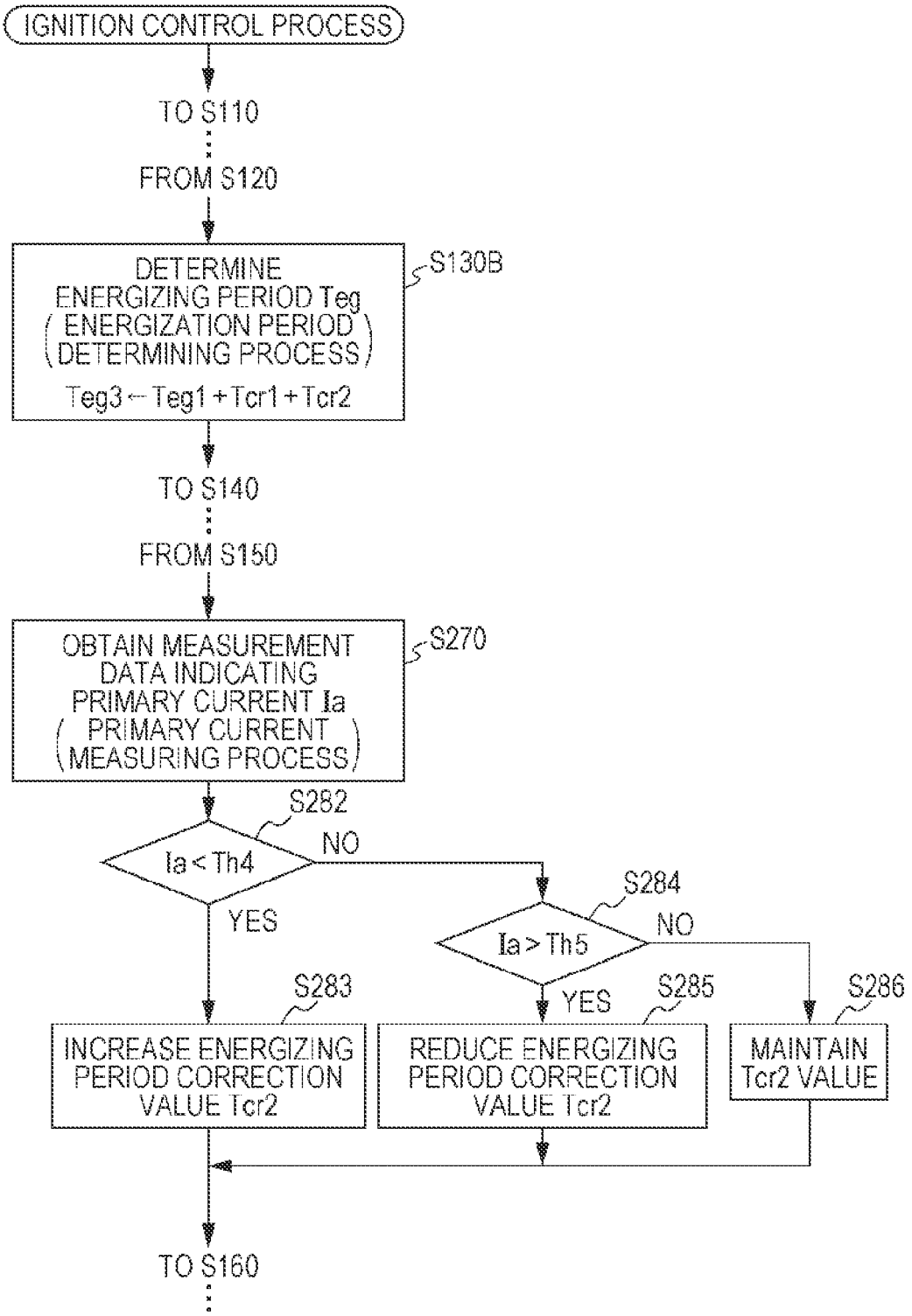
FIG. 7 is an explanatory diagram of an ignition control process in the second embodiment.

FIG. 7 is an explanatory diagram of an ignition control process in the second embodiment. The ignition control unit 600B executes the ignition control process at a timing corresponding to an operating state of the internal combustion engine.

The ignition control unit 600B executes an operating state determining process (Step S110) when starting the ignition control process similarly to the first embodiment. After executing the operating state determining process (Step S110), the ignition control unit 600B sets respective values corresponding to operating states (Step S120), similarly to the first embodiment.

After setting the respective values corresponding to the operating states (Step S120), the ignition control unit 600B determines an energizing period Teg by operating as the energizing period determining unit 660B (Step S130B). In this embodiment, the ignition control unit 600B determines the energizing period Teg by adding the energizing period correction value Tcr1 and energizing period correction value Tcr2 that has been set when executing the previous ignition control process to a reference energizing period Tbs that has been set in the current ignition control process. In this embodiment, the previous ignition control process does not exist if the ignition control unit 600 executes an initial ignition control process. Accordingly, the ignition control unit 600B assumes the respective energizing period correction value Tcr1 and the energizing period correction value Tcr2 as "0" to determine the energizing period Teg.

After determining the energizing period Teg (Step S130B), the ignition control unit 600B sets an energization starting time tst (Step S140). Then the ignition control unit 600B executes a first control process (Step S150).

After terminating the first control process (Step S150), the ignition control unit 600B executes a primary current measuring process (Step S270) by operating as the primary current measuring unit 670. In the primary current measuring process (Step S270), the ignition control unit 600B measures the current Ia energizing the primary winding 811 in the first control process (Step S150). In this embodiment, the ignition control unit 600B measures a maximum value of the current Ia by obtaining measurement data indicating the current Ia from the current detecting circuit 850. In this embodiment, the current detecting circuit 850 includes a peak hold circuit. This peak hold circuit holds the maximum value of the current Ia as electric charge accumulated in a capacitor. The ignition control unit 600B can measure the maximum value of the current Ia even after terminating the first control process (Step S150) by measuring the voltage of the capacitor in the peak hold circuit of the current detecting circuit 850.

After measuring the current Ia (Step S270), the ignition control unit 600B increases the energizing period correction value Tcr2 to be greater than the present value (Step S283) if the current Ia is smaller than a fourth threshold Th4 ("YES" at Step S282). The ignition control unit 600B uses this energizing period correction value Tcr2 in an energizing period determining process (Step S130) in the next ignition control process. After setting the energizing period correction value Tcr2, the ignition control unit 600B executes processes following the second control process (Step S160) similarly to the first embodiment.

After measuring the current Ia (Step S270), the ignition control unit 600B reduces the energizing period correction value Tcr2 to be smaller than the present value (Step S285) if the current Ia is larger than a fifth threshold Th5 ("YES" at Step S284). The ignition control unit 600B uses this energizing period correction value Tcr2 in an energizing period determining process in the next ignition control process (Step S130). After setting the energizing period correction value Tcr2, the ignition control unit 600B executes processes following the second control process (Step S160) similarly to the first embodiment.

If the current Ia is equal to or more than the fourth threshold Th4 and equal to or less than the fifth threshold Th5, ("NO" at Step S282 and "NO" at Step S284), the ignition control unit 600B maintains the energizing period correction value Tcr2 at its present value (Step S286). The ignition control unit 600B uses this energizing period correction value Tcr2 in the energizing period determining process (Step S130) in the next ignition control process. After setting the energizing period correction value Tcr2, the ignition control unit 600B executes processes following the second control process (Step S160) similarly to the first embodiment.

Figure 8:
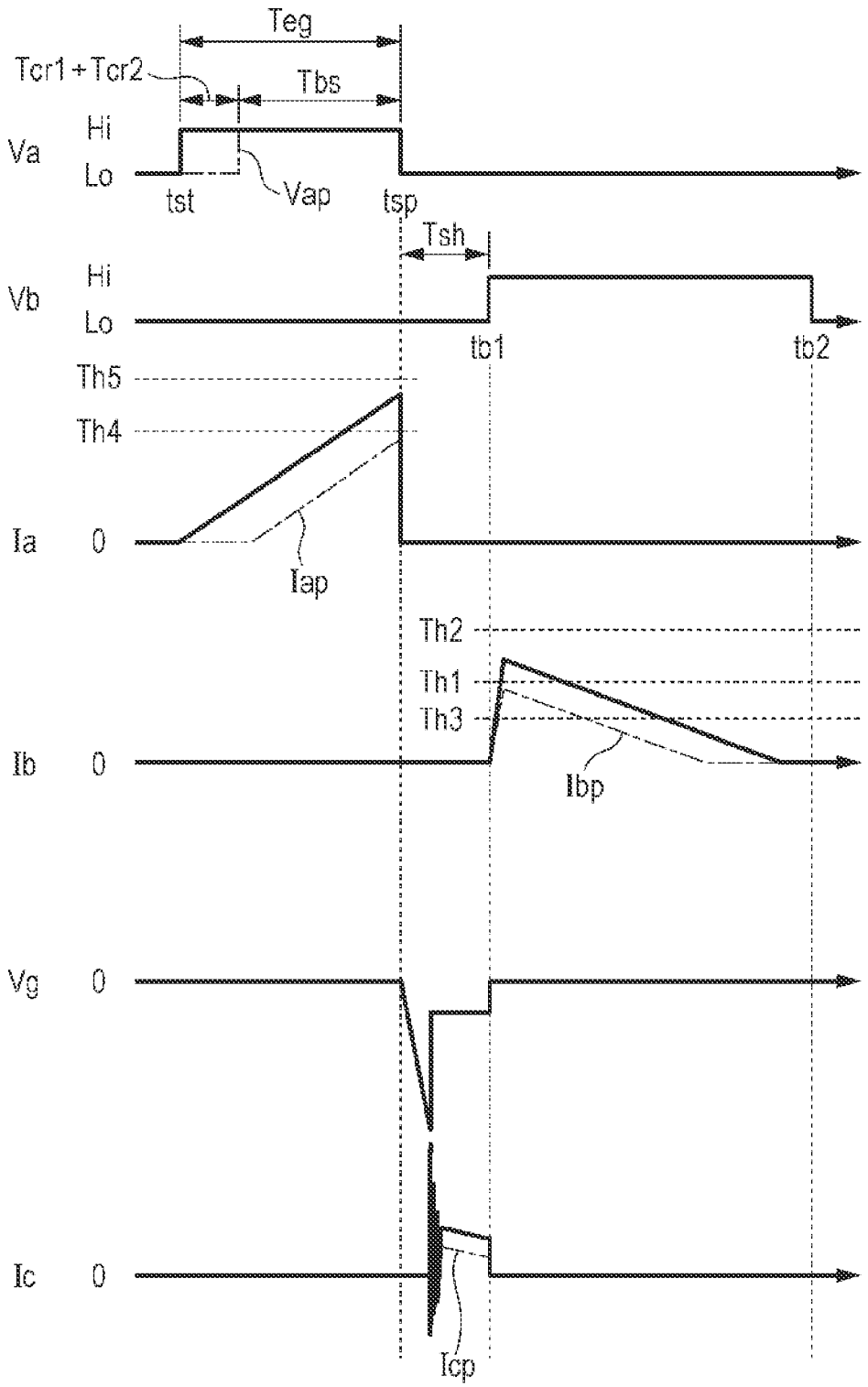
FIG. 8 is a timing chart of current and voltage wave forms generated through an ignition control process in an ignition system.

FIG. 8 is a timing chart of current and voltage wave forms in the ignition control process in the ignition system 10B. FIG. 8 illustrates respective wave forms similarly to FIG. 4. The timing chart in the second embodiment is similar to the timing chart in the first embodiment, except for the following points. That is, in the timing chart in the second embodiment, the energizing period Teg is a period based on the energizing period correction value Tcr1 and the energizing period correction value Tcr2. The current Ia, the current Ib, the voltage Vg, and the current Ic change according to this energizing period Teg.

According to the above-described second embodiment, the energizing period Teg of the current Ia, which allows sufficient supply of electric power to the spark plug 20 during the occurrence of spark discharge, is determined based on the current Ib, which is correlated to the energy that remains in the ignition coil 810 after spark discharge ends similarly to the first embodiment. Accordingly, a shortage of electric power required for ignition by spark discharge can be avoided. In addition, a variation in electric power supplied to the primary winding 811, resulting from a variation in the current Ia caused by the DC power source 700, the primary winding 811, the switch 820, or a similar factor, can also be reduced.

C. Third Embodiment

Figure 9:
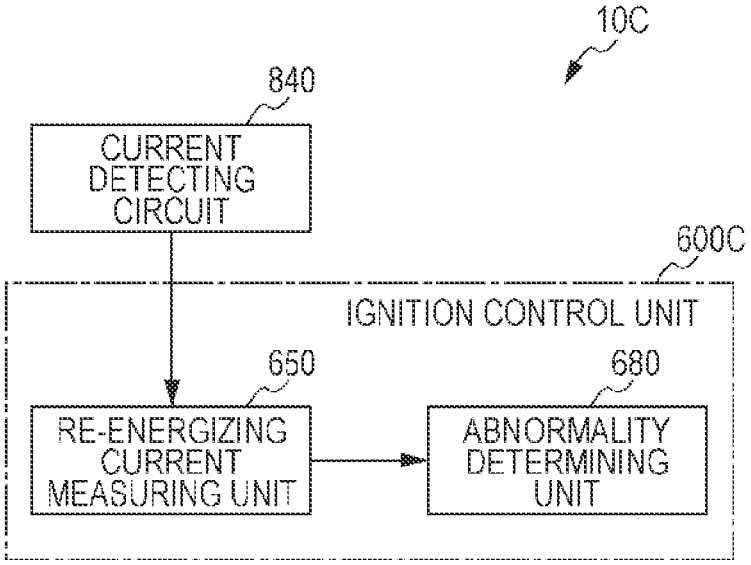
FIG. 9 is an explanatory diagram of an ignition system in a third embodiment.

FIG. 9 is an explanatory diagram of an ignition system 10C in a third embodiment. In FIG. 9, constituent elements similar to that of the first embodiment, of the ignition system 10C are omitted, except for the current detecting circuit 840 and the re-energizing current measuring unit 650. The ignition system 10C in the third embodiment is similar to the ignition system 10 in the first embodiment except that the ignition system 10C includes an ignition control unit 600C instead of the ignition control unit 600. The ignition control unit 600C in the third embodiment is similar to the ignition control unit 600 in the first embodiment, except that the ignition control unit 600C includes an abnormality determining unit 680.

The abnormality determining unit 680 of the ignition control unit 600C determines that the spark plug 20 is abnormal if the current Ib, which is measured by the re-energizing current measuring unit 650, is smaller than a third threshold Th3. The third threshold Th3 has a smaller value than the first threshold Th1. In this embodiment, the abnormality determining unit 680 stops ignition in the spark plug 20 if the abnormality determining unit 680 determines that the spark plug 20 is abnormal. In other embodiments, the abnormality determining unit 680 (or the ignition control unit 600C) may notify external control units of the abnormality when the abnormality determining unit 680 determines that the spark plug 20 is abnormal.

According to the above-described third embodiment, the energizing period Teg of the current Ia, which allows supply of sufficient electric power to the spark plug 20 during spark discharge, is determined based on the current Ib, which is correlated to the energy that remains in the ignition coil 810 after spark discharge ends, similarly to the first embodiment. Thus, shortage of electric power required for ignition by spark discharge can be avoided. In addition, the ignition in the spark plug 20 is stopped based on the determination that the spark plug 20 is abnormal. This allows the primary winding 811, and a circuit component (for example, the switch 820) that applies the current Ia to the primary winding 811 to avoid malfunction due to an excessive current.

D. Other Embodiments

The invention is not limited to the above-described embodiments, working examples and modifications, and may be practiced in various forms without departing from the spirit and scope of the claims appended hereto. For example, to achieve a part of or all of the above-described objects, or to achieve a part of or all of the above-described effects, the embodiments and the technical features in the above working examples and the modifications corresponding to the embodiments described in (1) to (5) above, may be, as needed, replaced or combined. Specific technical features can be deleted as well, if not described as being an essential element of the invention.

For example, the energizing period determining unit 660 may include one or both of the extension unit 662 and the shortening unit 664.

The abnormality determining unit 680 in the third embodiment can be applied to the second embodiment.

The ignition system 10 may include a plurality of spark plugs 20 in compliance with the specifications of an internal combustion engine and the plurality of ignition circuits 800 corresponding to respective spark plugs 20. In that case, the energizing period determining units 660 corresponding to respective spark plugs 20 may determine the energizing period Teg depending on the current Ib measured by the re-energizing current measuring unit 650 corresponding to respective spark plugs 20. Accordingly, a shortage of electric power required for ignition by spark discharge can be avoided for each of the spark plugs 20.

The polarity of the high voltage applied to the spark plug 20 from the ignition system 10 may be negative or positive. The ignition system 10 may be mounted on a vehicle or a stationary gas engine. These variations may be combined without particular limitation.

The foregoing detailed description has been presented for the purposes of illustration and description. Many modifications and variations are possible in light of the above teachings. It is not intended to be exhaustive or to limit the subject matter described herein to the precise form disclosed. Although the subject matter has been described in language specific to structural features and/or manipulative steps, it is to be understood that the subject matter defined in the appended claims is not limited to the specific features or acts described above. Rather, the specific features and acts described above are disclosed as example forms of implementing the claims appended hereto.

This application claims priority from Japanese Patent Application No. 2013-124529 filed Jun. 13, 2013, incorporated herein by reference in its entirety.

What is claimed is:

1. An ignition system, comprising:

a first control unit configured to generate a high voltage that is to be supplied to a spark plug at a secondary winding of an ignition coil by applying and then cutting off a primary current to a primary winding of the ignition coil;

a second control unit configured to cut off electric power to be supplied from the secondary winding to the spark plug by energizing the primary winding after the first control unit cuts off the primary current;

a re-energizing current measuring unit configured to measure a re-energizing current energizing the primary winding by the second control unit;

a primary current measuring unit configured to measure the primary current; and an energizing period determining unit configured to determine an energizing period during which the primary current is applied to the primary winding by the first control unit, corresponding to the re-energizing current measured by the re-energizing current measuring unit and the primary current measured by the primary current measuring unit.

2. The ignition system as claimed in claim 1, wherein the energizing period determining unit includes:

an extension unit configured to extend the energizing period so as to be greater than a reference value when the re-energizing current measured by the re-energizing current measuring unit is smaller than a first threshold; and a shortening unit configured to shorten the energizing period so as to be smaller than the reference value when the re-energizing current measured by the re-energizing current measuring unit is larger than a second threshold.

3. The ignition system as claimed in claim 1, further comprising an abnormality determining unit configured to determine that the spark plug is abnormal when the re-energizing current measured by the re-energizing current measuring unit is smaller than a third threshold.

4. The ignition system as claimed in claim 1, wherein the energizing period determining unit is configured to determine the energizing period corresponding to the re-energizing current measured by the re-energizing current measuring unit for each of a plurality of spark plugs associated with the ignition system.

* * * * *